US009498026B2

(12) United States Patent
Septien Rojas et al.

(10) Patent No.: US 9,498,026 B2
(45) Date of Patent: Nov. 22, 2016

(54) SPACED MULTI-RIB ZIPPER

(71) Applicant: ILLINOIS TOOL WORKS INC., Glenview, IL (US)

(72) Inventors: Jose Manuel Septien Rojas, Scarborough (GB); Martin Offa-Jones, North Yorkshire (GB); Steven Ausnit, New York, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 91 days.

(21) Appl. No.: 14/674,496

(22) Filed: Mar. 31, 2015

(65) Prior Publication Data

US 2015/0201716 A1 Jul. 23, 2015

Related U.S. Application Data

(63) Continuation of application No. 13/671,719, filed on Nov. 8, 2012, now Pat. No. 9,015,910.

(60) Provisional application No. 61/596,884, filed on Feb. 9, 2012.

(51) Int. Cl.

| | |
|---|---|
| ***A44B 19/16*** | (2006.01) |
| ***A44B 18/00*** | (2006.01) |
| ***B65D 33/25*** | (2006.01) |

(52) U.S. Cl.

CPC ..... *A44B 18/0053* (2013.01); *A44B 18/0061* (2013.01); *A44B 19/16* (2013.01); *B65D 33/2541* (2013.01); *Y10T 24/255* (2015.01); *Y10T 24/2532* (2015.01); *Y10T 24/2539* (2015.01); *Y10T 24/27* (2015.01); *Y10T 24/2767* (2015.01); *Y10T 24/2792* (2015.01); *Y10T 24/45178* (2015.01)

(58) Field of Classification Search

CPC ..... A44B 19/16; B65D 33/2541; B65D 33/2508; Y10T 24/2532; Y10T 24/2539; Y10T 24/255; Y10T 24/2792; Y10T 24/27

USPC ..... 24/399, 403, 409, 452, 516.11, 585.1, 24/585.12, DIG. 39, DIG. 50

See application file for complete search history.

(56) References Cited

U.S. PATENT DOCUMENTS

| | | | | |
|---|---|---|---|---|
| 3,495,306 A | | 2/1970 | Eichberg | |
| 3,586,220 A | | 6/1971 | Reisnberg | |
| 4,787,880 A | * | 11/1988 | Ausnit | B65D 33/2541 383/63 |
| 4,792,240 A | | 12/1988 | Ausnit | |
| 4,894,060 A | | 1/1990 | Nestegard | |
| 5,138,750 A | | 8/1992 | Gundlach et al. | |
| 5,179,767 A | | 1/1993 | Allan | |
| 5,235,731 A | | 8/1993 | Anzai et al. | |
| 5,398,387 A | | 3/1995 | Torigoe et al. | |

(Continued)

FOREIGN PATENT DOCUMENTS

| | | |
|---|---|---|
| WO | 98/31597 | 7/1998 |
| WO | 0230231 | 4/2002 |

OTHER PUBLICATIONS

International Search Report issued in International Application No. PCT/US2013/025018 on Apr. 17, 2013.

*Primary Examiner* — Robert J Sandy

(74) *Attorney, Agent, or Firm* — McCarter & English, LLP

(57) ABSTRACT

The present disclosure relates to a one piece multi-rib fastener including at least two groups of ribs, each rib with one or more hooks, wherein the groups are separated by a space less than the width of the maximum number of ribs within one of the groups.

16 Claims, 4 Drawing Sheets

(56) References Cited

U.S. PATENT DOCUMENTS

| | | | | |
|---|---|---|---|---|
| 5,930,877 | A * | 8/1999 | Thorpe | B65D 33/2533 24/304 |
| 6,231,236 | B1 | 5/2001 | Tilman | |
| 6,367,128 | B1 | 4/2002 | Galkiewicz et al. | |
| 6,546,604 | B2 | 4/2003 | Galkiewicz et al. | |
| 7,611,284 | B2 * | 11/2009 | Borchardt | B65D 33/2541 24/585.12 |
| 7,670,522 | B2 | 3/2010 | Ausen et al. | |
| 2003/0051320 | A1 * | 3/2003 | Fagan | A44B 18/0053 24/584.1 |
| 2003/0066267 | A1 | 4/2003 | Nelson | |
| 2006/0159372 | A1 | 7/2006 | Plourde et al. | |
| 2006/0165316 | A1 * | 7/2006 | Cheung | B65D 33/2541 383/63 |
| 2006/0168776 | A1 | 8/2006 | Dais et al. | |
| 2007/0206888 | A1 | 9/2007 | Chang | |
| 2007/0258665 | A1 | 11/2007 | Greco et al. | |

* cited by examiner

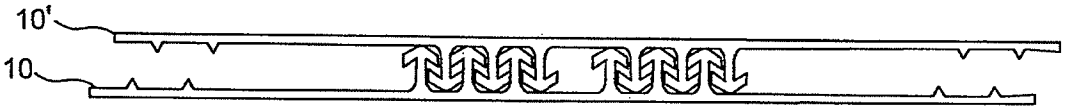
FIG. 2B
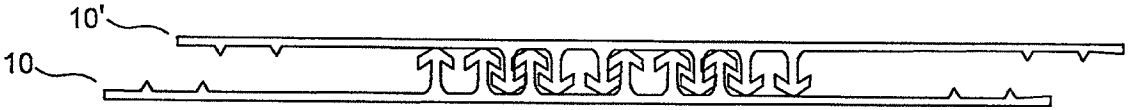
FIG. 2C
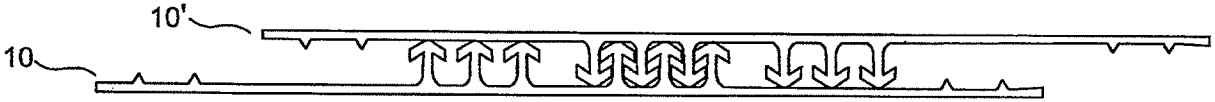
FIG. 2D
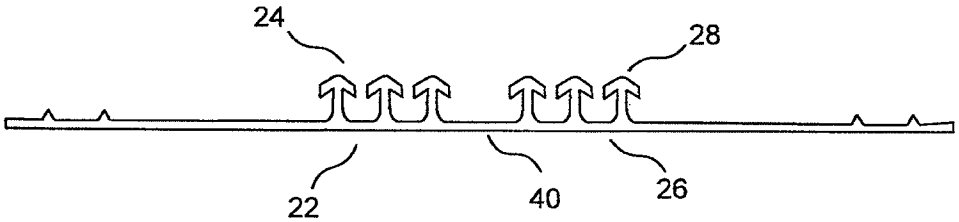
FIG. 2A
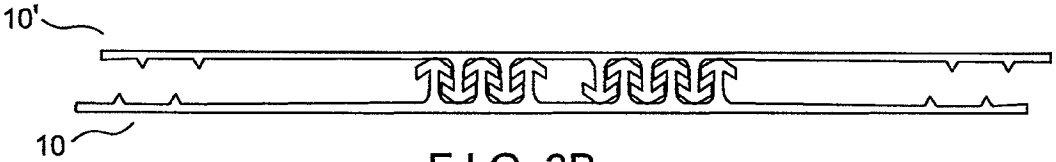
FIG. 3B
FIG. 3B

SPACED MULTI-RIB ZIPPER

This application is a continuation application of application Ser. No. 13/671,719, filed on Nov. 8, 2012, now U.S. Pat. No. 9,015,910, which claims priority under 35 U.S.C. §119(e) of U.S. provisional patent application Ser. No. 61/596,884 filed on Feb. 9, 2012, the contents of both are hereby incorporated by reference in their entirety for all purposes.

BACKGROUND OF THE DISCLOSURE

Field of the Disclosure

The present disclosure relates to zipper for a reclosable package, wherein the zipper includes a multi-rib fastener including at least two groups of ribs, each rib with one or more hooks.

Description of the Prior Art

In the prior art, multi-alignment zippers are well known. While these zippers are well-developed and suitable for their intended purposes, further improvement are sought with respect to the strength of the interlocked zipper, especially when the profiles are not perfectly aligned and parallel when closed, and with respect to leak-resistance.

OBJECTS AND SUMMARY OF THE DISCLOSURE

It is therefore an object of the present disclosure to provide improvements in reclosable zippers, particularly with respect to strength, particularly providing a range of alignments, and with respect to leak-resistance.

This and other objects are attained by providing profiles which are one-piece multi-rib fasteners including at least two groups of ribs, each rib with one or more hooks, wherein the groups of ribs are separated by a space less than the width of the maximum number of ribs within one of the groups and wherein the total number of ribs in each of the groups may be at least two, and perhaps more.

BRIEF DESCRIPTION OF THE DRAWINGS

Further objects and advantages of the disclosure will become apparent from the following description and from the accompanying drawings, wherein:

FIG. 2A is a cross-sectional view of an embodiment of the multi-rib fastener of the present disclosure.

FIGS. 2B-2D illustrate various closure configurations of the embodiment of FIG. 2A.

FIG. 3B illustrates a closure configuration of the embodiment of FIG. 3A.

DETAILED DESCRIPTION OF THE PREFERRED EMBODIMENTS

Figure 1A:
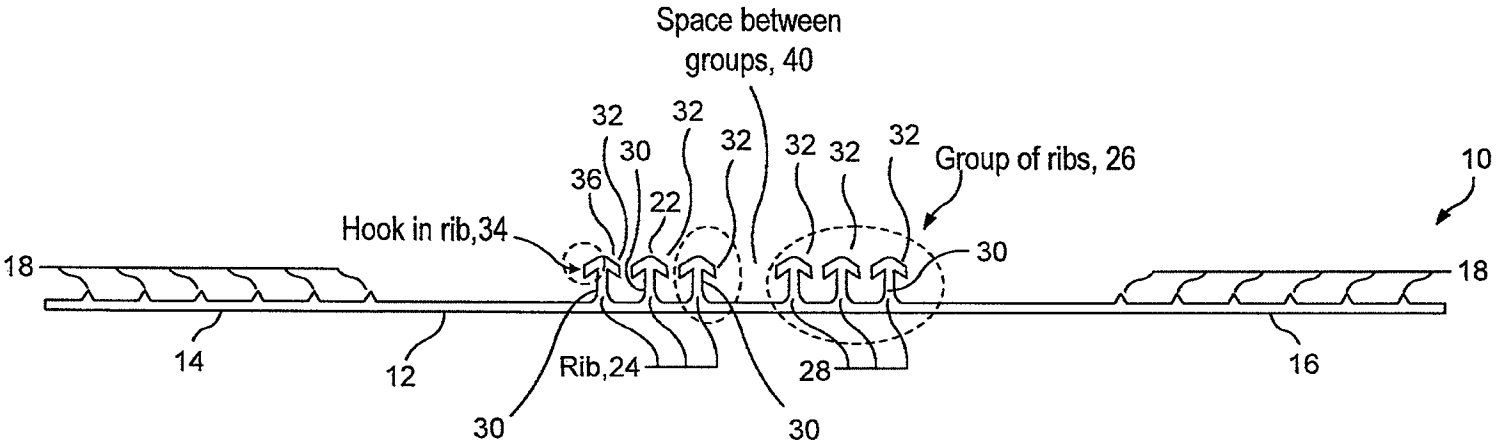
FIG. 1A is a cross-sectional view of a typical multi-rib fastener of the present disclosure.
Figure 1B:
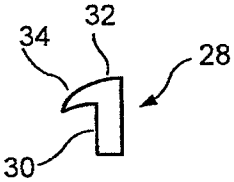
FIG. 1B is a cross-sectional view of a rib with a single hook.

Referring now to the drawings in detail wherein like numerals indicate like elements throughout the several views, one sees that FIG. 1A illustrates a multi-rib fastener 10 with a base 12 forming a first flange 14 and a second flange 16. Multi-rib fastener 10 is typically an integral configuration made from a polymeric material. First and second flanges 14, 16 include upwardly extending anti-seal protrusions 18. Multi-rib fastener 10 of FIG. 1A further includes ribs 20 which are arranged in a first group 22 of three ribs 24 and a second group 26 of three ribs 28. In the configuration and orientation of FIG. 1A, all ribs 24, 28 are pointing upwardly and are parallel with each other. Ribs 24, 28 are male-type elements with posts 30 and arrowhead-shaped tip 32. Arrowhead-shaped tip 32 is formed from left hook 34 and right hook 36 (numerals shown on leftmost rib 24 only in FIG. 1A). FIG. 1B illustrates an embodiment of rib 24' with a single hook 34. First group 22 of ribs 24 is separated by second group 26 of ribs 28 by space or gap 40. Space or gap 40 typically has a width less than the width of either the first or second group 22, 26 of ribs 24, 28.

While ribs 24, 28 have a male-type configuration, the arrangement of the left and right hooks 34, 36 allow the ribs from opposing identical or substantially identical multi-rib fasteners 10, 10' to inter-engage with each other thereby forming a closure or zipper as shown in FIGS. 2B-2D. It can be envisioned that female elements are formed between immediately adjacent ribs 24 or 28, for receiving the rib 24 or 28 of the opposing multi-rib fastener 10 or 10'. In other words, immediately adjacent ribs form a space for receiving and inter-engaging ribs from an opposing multi-rib fastener. In FIG. 2B, the ribs 24, 28 of multi-rib fasteners 10, 10' are aligned with each other and fully engaged so that two ribs are received within each group of ribs of the opposing fastener. In FIG. 2C, the multi-rib fasteners 10, 10' are slightly offset so that only one rib is received within each group of ribs of the opposing fastener. In FIG. 2D, only one group of ribs of each multi-rib fastener is inter-engaged.

Figure 3A:
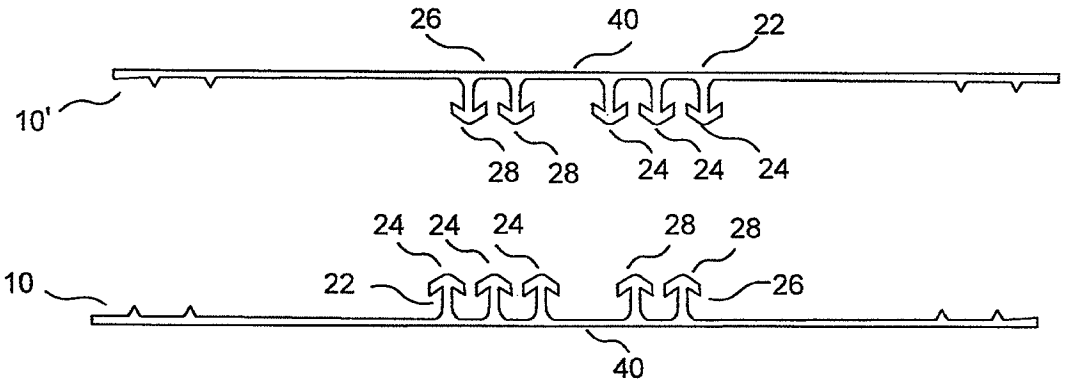
FIG. 3A is a cross-sectional view of a further embodiment of the multi-rib fastener of the present disclosure.

FIGS. 3A and 3B disclose a similar embodiment wherein first group 22 includes three ribs 24 but second group 26 includes two ribs 28. FIG. 3A illustrates the multi-rib fasteners 10, 10' separated and FIG. 3B illustrates the multi-rib fasteners 10, 10' engaged.

Figure 4B:
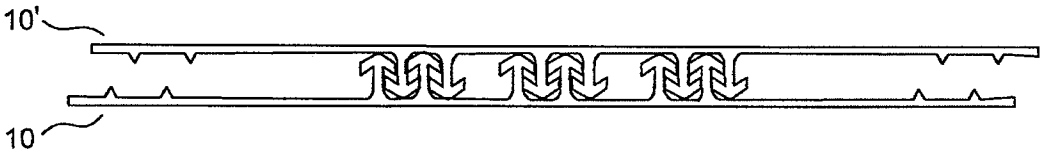
FIG. 4B illustrates a closure configuration of the embodiment of FIG. 3A.
Figure 4A:
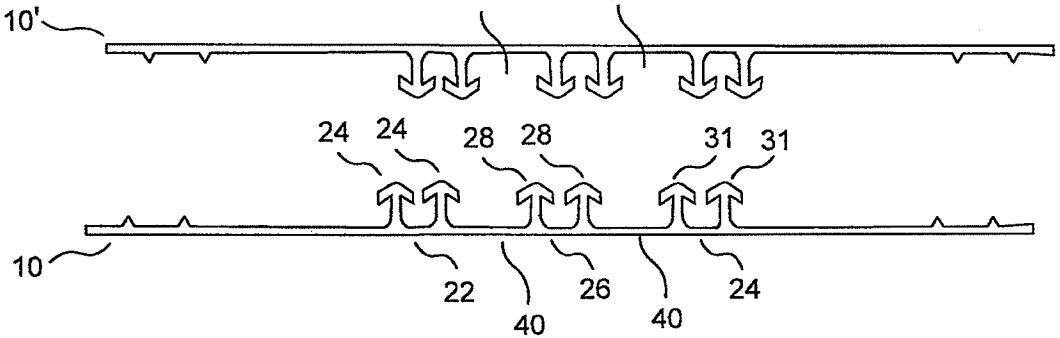
FIG. 4A is a cross-sectional view of a further embodiment of the multi-rib fastener of the present disclosure.

FIGS. 4A and 4B disclose a similar embodiment wherein first group 22, second group 26 and third group 29 each include two ribs 24, 28, 31, respectively. It is envisioned that, typically, the multi-rib fasteners 10 or 10' would not include less than a total of five ribs. Likewise, it is envisioned that it is possible that multi-rib fastener 10 may have a different groups of ribs than on multi-rib fastener 10' (for instance the multi-rib fastener 10 of FIG. 3A may be combined with the multi-rib fastener 10' of FIG. 4A).

It is envisioned in all of the embodiments that the gap or space 40 between groups of ribs will facilitate the closing of the profile as compared to a closure with a similar number of ribs but with no spaces between the groups of ribs.

The force required to close the profile and to open it, as well as the sound made by those actions will be related to the configuration of the groups of ribs and the spaces therebetween, the number of ribs interacting with each other, the size of the ribs, the size and number of hooks on those ribs, the angle of those hooks, the type of polymer used and any intentional mechanical deformation applied to those ribs. Different variation of all these parameters can be used to modify the opening force, closing force and sounds generated.

Figure 5:
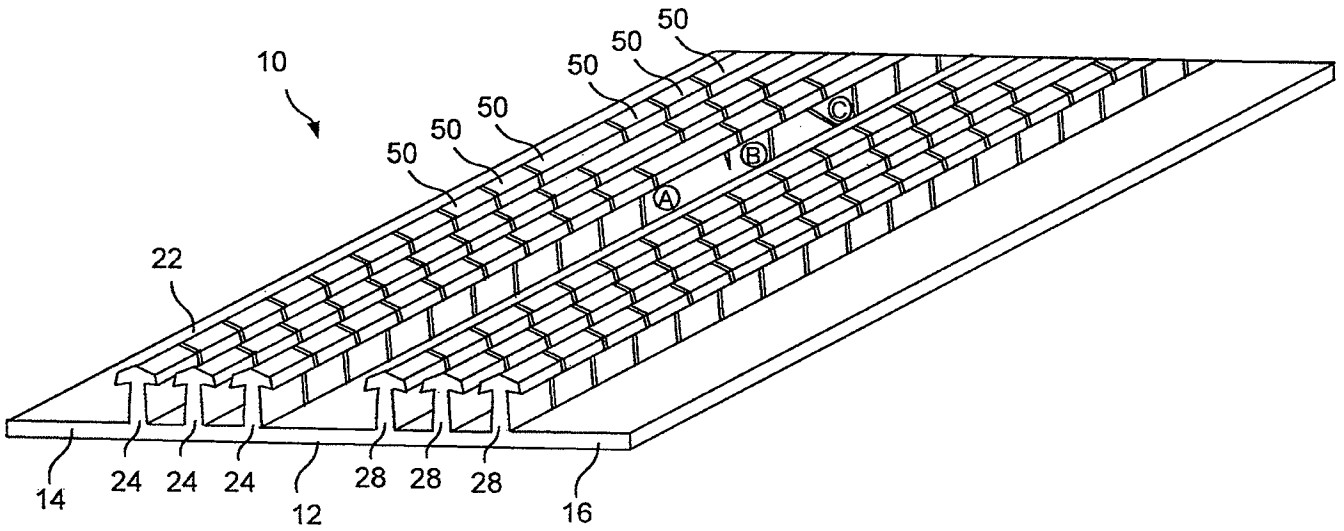
FIG. 5 is a perspective view of a further embodiment of the present disclosure.

Additionally, as shown in FIG. 5 it is envisioned that some profiles may include transversal cuts 50. These cuts 50 could be perpendicular to the longitudinal direction of the ribs as shown in FIG. 5 or at an angle as shown at C in FIG. 5. The space between cuts can vary (as shown at A in FIG. 5) as well as the depth of the cuts (as shown at B in FIG. 5). Different groups of ribs could have different cuts, angle, frequency and penetration. Additionally, as shown by A, B and C of FIG. 5, the cuts 50 could be different in various locations or different ribs of the multi-rib fastener 10.

A typical advantage of a zipper closure formed from multi-rib fasteners as disclosed herein is that with the indicated groups of ribs, spaces between groups and cuts, improved interlocking will be achieved even when the groups are interlocked but are not perfectly aligned and parallel when closing.

Similarly, another typical advantage of the disclosed embodiments is that improved leak resistance is achieved.

It is envisioned that the zipper could include two separate multi-rib fastener with equal or different rib constructions and configuration or could be in a single self-mating constructions.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A closure, comprising:

a fastener including at least a first group of ribs and a second group of ribs, wherein the first group of ribs is separated from the second group of ribs by a gap with a width less than a width of the first group or the second group;

the first group of ribs including a plurality of immediately adjacent ribs wherein the space between the immediately adjacent ribs can receive a rib from an opposing fastener and interlock therewith;

wherein the gap between the first group of ribs and the second group of ribs is greater than a space between immediately adjacent ribs within the first or second group of ribs; and wherein a shape of the first group of ribs is substantially identical to a shape of the second group of ribs thereby forming a single self-mating construction.

2. The closure of claim 1 wherein the fastener is formed from polymeric material.

3. The closure of claim 2 wherein the fastener forms an integral construction.

4. The closure of claim 1 further including a first flange extending away from the first group of ribs and a second flange extending away from the second group of ribs.

5. The closure of claim 1 wherein the ribs of the first and second groups include a post terminating in an arrowhead-shaped tip.

6. The closure of claim 5 wherein the arrowhead-shaped tip forms a hook on both sides of the rib, wherein the hooks of opposing fasteners inter-engage in a closed position.

7. The closure of claim 6 wherein the first group of ribs includes three ribs and the second group of ribs includes three ribs.

8. The closure of claim 1 wherein the ribs include cuts which are transverse to a longitudinal direction of the ribs.

9. The closure of claim 1 wherein the ribs include cuts which are perpendicular to a longitudinal direction of the ribs.

10. The closure of claim 1 wherein the ribs include cuts which are at an angle other than ninety degrees to a longitudinal direction of the ribs.

11. The closure of claim 1 wherein the ribs include cuts, wherein a first portion of the cuts have a different depth than the depth of a second portion of the cuts.

12. The closure of claim 1 wherein the ribs include cuts, wherein spacing of the cuts is non-uniform.

13. The closure of claim 1 wherein the ribs include cuts, wherein cuts on a first portion of the ribs is different from cuts on a second portion of the ribs.

14. The closure of claim 1 wherein the total number of ribs in the first and second groups is at least five.

15. The closure of claim 1 wherein the ribs each include one and only one hook.

16. The closure of claim 1 wherein a first portion of the fastener and a second portion of the fastener can interlock with each other in the absence of alignment.

* * * * *